United States Patent [19]

Riccio

[11] 4,162,765

[45] Jul. 31, 1979

[54] AEROSOL DISPENSER UTILIZING $CO_2$ AS PROPELLANT

[76] Inventor: Pasquale R. Riccio, 54 Pelham Rd., Salem, N.H. 03079

[21] Appl. No.: 871,983

[22] Filed: Jan. 24, 1978

[51] Int. Cl.[2] ..... B05B 7/32

[52] U.S. Cl. ..... 239/337; 222/402.13

[58] Field of Search ..... 239/307, 308; 222/402.1, 402.13–402.15, 402.24, 402.25; 239/337, 573

[56] References Cited

U.S. PATENT DOCUMENTS

| | | | |
|---|---|---|---|
| 3,061,203 | 10/1962 | Kitabayashi | 222/402.24 |
| 3,371,825 | 3/1968 | Cullen | 239/344 |
| 3,451,596 | 6/1969 | Marand | 239/308 |

*Primary Examiner*—Robert J. Spar
*Assistant Examiner*—H. Grant Skaggs
*Attorney, Agent, or Firm*—Wenderoth, Lind & Ponack

[57] ABSTRACT

An aerosol type dispensing package utilizing $CO_2$ as a propellant has a container with a dispensing valve having a passage extending longitudinally through the nozzle thereof and at least one lateral passage opening into the longitudinal passage. Separate flow paths extend from obturator means in the valve to the central passage and to the lateral passage. The obturator means obturates a main flow path from a dip tube and is movable to the open position upon actuating of the valve. The dip tube extends from the valve means to near the bottom of the container and is in communication with the main flow path. A body of a solution of a product to be dispensed in a liquid in which $CO_2$ can be dissolved fills the container to a level below the top of the container for leaving a gas space in the upper part of the container. Compressed carbon dioxide is present in the space in the container above the body of solution.

2 Claims, 4 Drawing Figures

AEROSOL DISPENSER UTILIZING $CO_2$ AS PROPELLANT

This invention relates to an aerosol type dispensing package, and more particularly to such a package of a particular dispenser structure having therein a solution of the product to be dispensed, preferably in the form of a so-called fine particle spray, and carbon dioxide as the propellant for dispensing the product.

BACKGROUND OF THE INVENTION

Prior Art

Aerosol type dispensers have been in wide use for many years. The most commonly used type has been a container in which is contained a liqiud material to be dispensed. In a very common arrangement, in the space within the container above the liquid is a pressurized gaseous propellant which exerts a pressure on the liquid. A dip-tube extending downwardly into the container and having a valve means at the top thereof, normally pushbutton actuated, acts as a control to release the fluid, which is forced through the dip-tube from the interior of the container by the pressure of the propellant on the upper surface of the fluid.

With respect to the propellants used in such dispenser, one common system is the system which uses an alcohol solution of the material to be dispensed and the propellant is Freon which is largely dissolved in the solution, and has a gaseous phase normally in equilibrium with the solution on the order of 60 PSIG (about 4KG/cm$^2$ above ambient). While this produces relatively good atomization of the fluid being dispensed, with droplet sizes on the order of 10 microns or less, it has the major disadvantage that the propellant is relatively expensive as compared with some other gases which might be satisfactory as propellants, and moreover it is incompatible with some products which it might be desired to dispense from such an aerosol type dispenser.

Moreover, Freon has recently come under attack not only as being dangerous from a medical standpoint when inhaled, but also as having an adverse effect on the ionosphere. Consideration is currently being given to banning the use of Freon as a propellant for dispensing material from aerosol type dispensers.

A second common system is the so-called aqueous system in which the product is in an aqueous solution and a hydrocarbon propellant, such as isobutane or isobutane-propane mixtures are used, the gaseous phase of which is in equilibrium with the aqueous phase at pressures of about 45 PSIG and above. However, despite the use of an aqueous solution, there is still some danger from the use of hydrocarbon propellants because they are flammable. Moreover, they are also incompatible with certain materials which it might be desired to dispense with aerosol type dispensers.

Compressed carbon dioxide has been tried as a propellant, but because of its characteristics it has been found that in conventional aerosol dispensers the spray is coarse or barely satisfactory when the $CO_2$ is at high pressure just after the dispenser has been filled and charged with propellant and for a time until about half the product has been dispensed. Thereafter the atomizing and spray pattern deteriorate to an extent that dispensing is unsatisfactory for many purposes. While $CO_2$ has been used where such deteriorating of the atomization and spray pattern are of no concern, e.g. in the dispensing of foodstuffs, it has not been found to be useful in areas where atomization and spray patterns are important, e.g. in dispensing of medicaments, hair sprays and other similar consumer products.

However, the properties of $CO_2$ such as its inertness and solubility over a good temperature range, and its low cost as compared to other propellants, make it an attractive propellant from a commercial standpoint.

It would be highly desirable if an aerosol dispensing package could be provided which made possible the use of carbon dioxide as the propellant for dispensing of solutions of a product without having any significant detrimental effect on the fineness of the spray of fluent materials being dispensed during the course of dispensing the product, so that the drawbacks of using Freon or a hydrocarbon propellant can be avoided.

OBJECTS AND BRIEF DESCRIPTION OF THE INVENTION

It is an object of the present invention to provide an aerosol type dispensing package for dispensing a fine spray and having a valving system which makes possible the utilization of carbon dioxide as propellant.

Applicant has discovered that by using a particular structure of an aerosol type dispenser with $CO_2$ dissolved in the solution of the product to be dispensed, dispensing of the solution of material in a fine spray can be completely achieved without significant deterioration of the fineness of the spray or the pattern of the spray.

Thus the object of the invention is achieved by the provision of a package of an aerosol type dispenser having a container, a dispensing valve means on said container having a nozzle means on the outside of the container with a passage extending longitudinally therethrough and at least one lateral passage opening into said longitudinal passage, separate flow paths through said valve means to said nozzle means, one path extending to said central passage and the other path extending to said lateral passage, valve actuating means forming part of said valve means and including obturating means, said valve having a main flow path extending to said obturating means and obturating means obturating said main flow path and being movable to the open position upon actuating of said valve actuating means, dip tube means extending from said valve means to near the bottom of said container and being in communication with said main flow path where it is connected to said valve means, a body of a solution of a product to be dispensed in said container and filling said container to a level below the top of the container for leaving a space in the upper part of said container above said body of solution, and carbon dioxide in solution in the solution and in gaseous form in the space in said container above said body of solution and in equilibrium with the solution.

BRIEF DESCRIPTION OF THE FIGURES

These objects and other objects will become apparent from the following description, taken together with the accompanying drawings, in which.

DETAILED DESCRIPTION OF THE INVENTION

Figure 1:
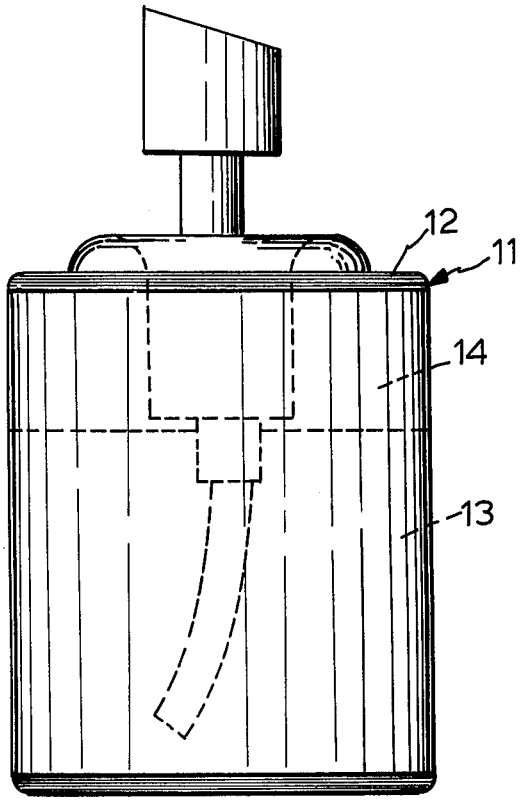
FIG. 1 is a sectional view of the aerosol type dispensing package according to the present invention.
Figure 2:
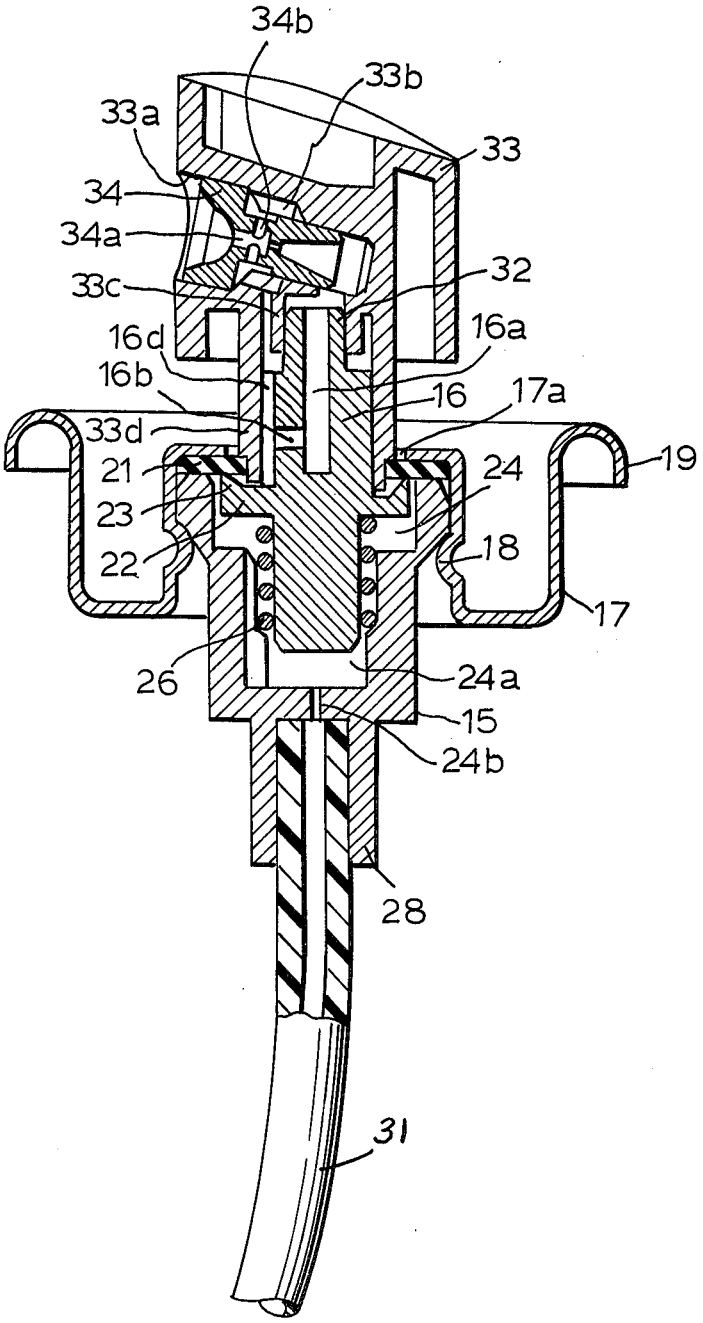
FIG. 2 is a fragmentary enlarged sectional view of the dispensing valve means of the aerosol type dispensing package of FIG. 1, with the parts in the rest of non-dispensing position.
Figure 3:
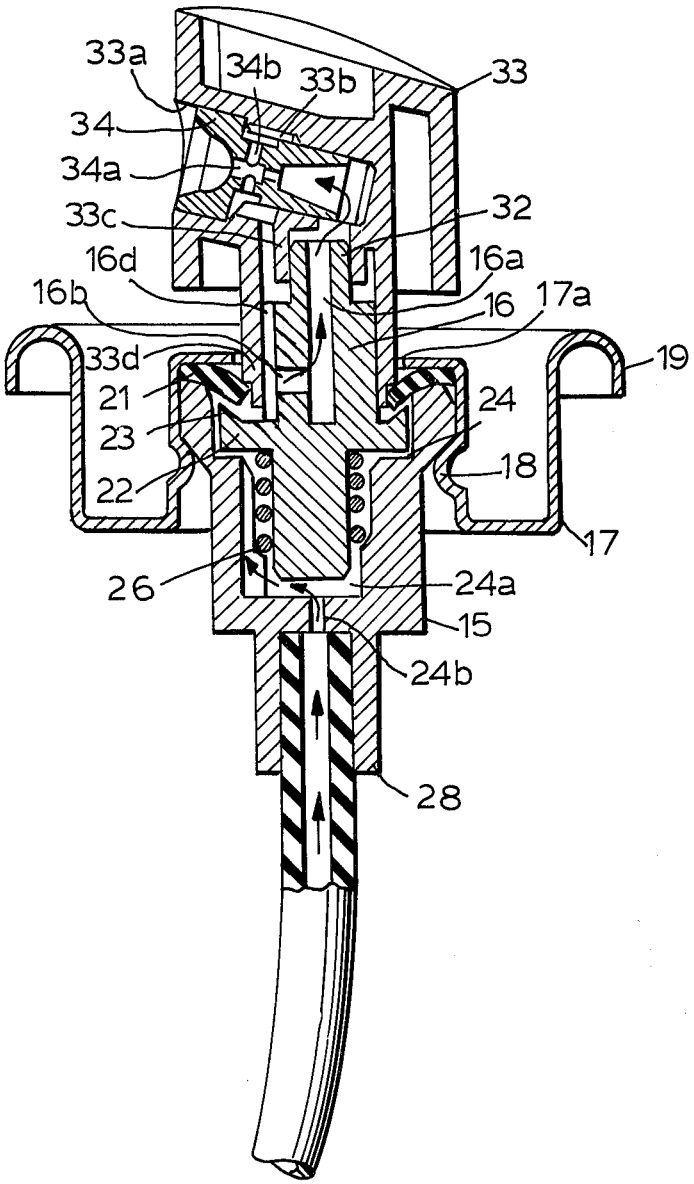
FIG. 3 is a view similar to FIG. 2 with the parts in the dispensing position.

Referring to FIGS. 1–3, the container and dispensing means for the aerosol type dispensing package of the present invention has a container 11 which has a container top wall cover portion 12 at the upper end thereof. The container holds a body 13 of a solution of a solvent containing the product to be dispensed and dissolved carbon dioxide, and further contains in the space 14 above the body of the solution a supply of gaseous carbon dioxide under pressure in equilibrium with the solution. The gaseous carbon dioxide exerts a pressure directly on the liquid 13.

Dispensing valve means is provided on the container 11 which comprises a support 15 having a partially hollow stem 16 movably mounted therein. The support 15 is mounted on the underside of a mounting member in the form of a mounting cup 17. In the present arrangement, the central portion of the mounting cup 17 is bent over the upper end of the support 15 and secured thereto by an annular crimp 18 which is deformed under the overhanging edge of the upper portion of support 15. The mounting cup has a lip 19 which overhangs a corresponding upwardly projecting annular portion on the container top wall, and the cup 17 is sealed to the annular portion by a flow-in gasket (not shown). The mounting cup 17 has a central opening **17*a* through which the stem 16 is freely movable, and secured between the upper end of the support 15 and the cup 17 is an obturating means in the form of a sealing gasket 21**, which will be described in greater detail hereinafter.

Immediately below the gasket 21 on the stem 16 is a flange 22 which has an upwardly projecting annular lip 23 which, when the stem is in the rest or raised position as shown in FIG. 2, engages tightly against the sealing gasket 21. The lower portion of the stem 16 and the flange 22 are positioned within the hollow interior 24 of the support 15. In the bottom of the hollow interior 24 is a recess **24*a* from which a downwardly extending bore 24*b*** extends.

A spring 26 is held between the bottom of the flange 22 and the lower end of the recess **24*a*, and urges the stem 16** in the upward direction.

The hollow stem 16 has a lateral opening **16*b* opening out of the longitudinal central duct 16*a*** of the stem.

Fitted onto the lower end of the support 15 is a tail piece 28. A dip-tube 31 has the upper end fitted into the tailpiece 28, and has the lower end extending downwardly to a position near the bottom of the container 11.

Along the outer portion of the upper end of the stem 16 is at least one groove **16*d* which terminates at a pushbutton receiving projection 32 on the upper end of the stem 16**.

Valve actuating means is provided in the form of a pushbutton 33 having a downwardly extending inner sleeve **33*c* fitted tightly over the upper end of the stem 16 and has nozzle means in the form of a nozzle insert 34 set into a cavity 33*a* in the pushbutton 33 so as to leave a propellant supply chamber 33*b* around the nozzle insert. The hollow interior of inner sleeve 33*c* communicates with the rear of the recess 33*a*. A depending outer sleeve 33*d* fits over the outside of the stem 16 so as to enclose the groove 16*d*, and the space between the inner sleeve 33*c* and the outer sleeve 33*d* communicates with the propellant supply chamber 33*b***.

The nozzle insert 34 has a central Venturi passage **34*a* therethrough from the rear of recess 33*a* and laterally extending propellant supply passages 34*b* extending laterally into the propellant supply chamber 33*b***.

In the rest position of the parts, as shown in FIG. 2, the outer sleeve **33*d* extends downwardly into sealing contact with the inner edge of the gasket 21 where it extends inwardly past the edge of the opening 17*a* in the mounting cup 17**.

It will thus be seen that in the valve means there is provided a flow path means defining a main flow path from the container 11 and the dip-tube 31 through the valve means past the obturating means, i.e. the gasket 21. This main path is obturated by the sealing gasket 21 as the stem moves upwardly and downwardly.

From this point there is one path through the lateral aperture **16*b* and the hollow interior 16*a* of the stem 16, and a second path through the groove 16*d* and the annular space between the inner and outer sleeves 33*c* and 33*d* to the propellant supply chamber 33*b***.

With the parts in the positions as shown in FIG. 2, the main flow path is closed, since the annular lip 23 is sealed against the gasket 21, so that the pressurized contents of the container cannot flow past the gasket 21.

When the stem is depressed by finger pressure on the pushbutton 33, the parts will move to the positions as shown in FIG. 3, that is the stem will move downwardly compressing the spring 26. At the time of the downward movement of the stem 16, the annular lip 22 moves away from the sealing gasket 21 and the lower end of the outer sleeve **33*d* depresses the inner edge of the sealing gasket 21, thereby opening a passage past the lip 22 and under the edge of the gasket 21. The pressure of the gaseous carbon dioxide in the space 14 forces the liquid 13 up the dip-tube 31 and the main flow path to the gasket 21, and the one path to the central passage 34*a* through the nozzle insert 34 as well as the second path up the groove 16*d* into the annular recess between the sleeves 33*c* and 33*d*** and into the propellant supply is open to the flowing liquid.

Since the liquid contains dissolved $CO_2$ under pressure as the liquid flows along the main flow path and particularly as it flows along the one path and the second path the pressure on the dissolved $CO_2$ is released and it expands into its gaseous form. This produces a mixture of liquid and gas flowing through the central passage **34*a* and the lateral passages 34*b* where it strikes the flow of the mixture of liquid and expanding gas in the passage 34*a*, thus further shearing this liquid so as to produce a fine spray. Since the gas is still expanding as the mixture of gas and liquid reaches the outer end of passage 34*a***, a spray of fine droplets is produced.

When the pushbutton 33 is released, and the stem 16 rises and the flow paths are closed, propellant will evaporate from the liquid until the pressure in space 14 equalizes, at which time the dispenser package will again be ready for use.

It has been found that by using the valve structure as just described, a solution of the product to be dispensed can be dispensed in a fine spray by means of carbon dioxide.

It has been found that with the construction as described above, and with a nozzle insert having the diameter of the Venturi passage from about 0.008 to 0.012 in.

where the $CO_2$ is provided at an initial pressure in the range of 90 to 100 PSIG, a solution can be dispensed in a spray of fine droplets the spray pattern and atomization of which are better than that produced by a conventional aerosol valve structure and using $CO_2$ as a propellant, and moreover which spray pattern and atomization do not substantially deteriorate, as compared with a spray produced by a conventional aerosol valve structure using $CO_2$ as a propellant over the course of the dispensing of the solution even when the pressure drops to as low as about 15 to 20 PSIG. Sufficient $CO_2$ can be dissolved in the solution so that all of the solution in a given dispenser can be dispensed by the time the pressure drops to 15 to 20 PSIG.

Since the dispenser structure can function to maintain the spray fineness and pattern at these low pressures, it is especially useful in combination with $CO_2$ as a propellant.

As solvents for the products to be dispensed there can be used any solvent which is compatible with the product, i.e. will not have any adverse effect on it, and which is capable of having $CO_2$ dissolved therein. Where the headspace is about 10% of the volume of the container the solvent should have an Ostwald solubility coefficient with respect to $CO_2$ of no lower than about 0.80, and where the headspace is about 25%, the Ostwald solubility coefficient should be no lower than 0.3. This insures a pressure of about 20 PSIG in the container when all of the solution is dispensed. Reference is made in this regard to Hsu, Calculations For Formulations With Soluble Gases; Aerosol Age, December, 1964.

Among the suitable solvents are: acetone, benzene, N-butyl alcohol, chloroform, ethyl ether, ethyl alcohol, N-hexyl alcohol, mesitylene, methyl alcohol, octyl alcohol, amylacetate, amyl alcohol, carbon tetrachloride, cyclohexane, 100 octane fuel, toluene, m-toluidine, kerosine, lube oil, pyridine, water, xylene and propyl alcohol.

Figure 4:
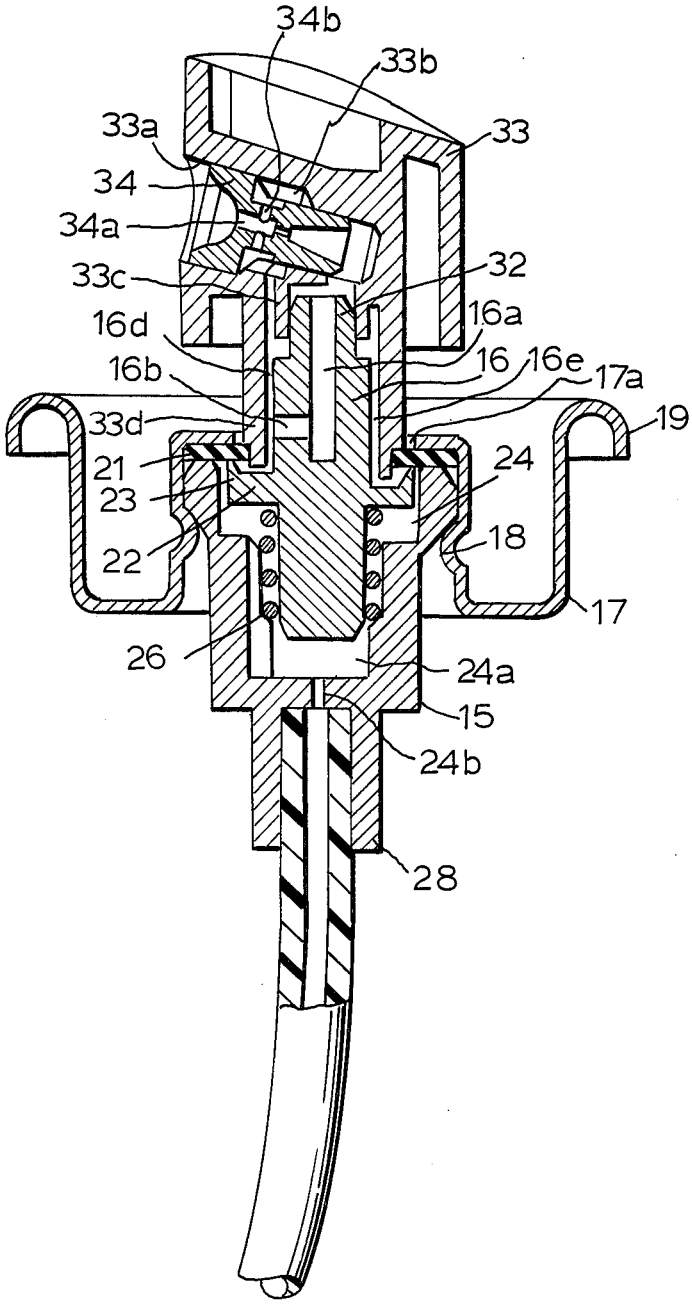
FIG. 4 is a view similar to FIG. 2 of a slightly modified form of valve means.

The modification shown in FIG. 4 differs from that in FIG. 3 only in that an annular space 16*e* has been left around stem 16 instead of groove 16*d*, and lateral hole 16*b* opens into this space 16*e*.

What is claimed is:

1. An aerosol type dispensing package comprising: a container; a dispensing valve means on said container having a nozzle means on the outside of the container with a passage extending longitudinally therethrough and at least one lateral passage opening into said longitudinal passage, a main flow path extending part way through said valve means from within said container, valve actuating means forming part of said dispensing valve means and including obturating means obturating the end of said main flow path within said valve means and movable to the open position upon actuating of said valve actuating means; one flow path extending from said end of said main flow path through said dispensing valve means from said obturating means to said longitudinal passage and a second flow path extending from said end of said main flow path through said dispensing valve means from said obturating means to said lateral passage, dip tube means extending from said valve means to near the bottom of said container and being in communication with said main flow path where it is connected to said valve means; a body of a solution of a product to be dispensed in said container and filling said container to a level below the top of the container for leaving a gas space in the upper part of said container above said body of solution; and a carbon dioxide propellant under pressure and dissolved in said solution and in gaseous form in the space in said container above said body of solution.

2. An aerosol type dispensing package as claimed in claim 1 in which said carbon dioxide is at a pressure having an upper limit of 90–100 PSIG and a lower limit of 15–20 PSIG.

* * * * *